United States Patent [19]

Fattore

[11] Patent Number: 4,767,419

[45] Date of Patent: Aug. 30, 1988

[54] PROTECTIVE PAD FOR CRIB RAIL

[76] Inventor: Mary E. Fattore, 231 Chestnut St., Turnersville, N.J. 08012

[21] Appl. No.: 101,469

[22] Filed: Sep. 28, 1987

[51] Int. Cl.[4] ..... A47D 15/00

[52] U.S. Cl. ..... 5/508; 5/424; 446/227

[58] Field of Search ..... 5/93 R, 424, 508, 101; 248/345.1; 446/227

[56] References Cited

U.S. PATENT DOCUMENTS

| | | | |
|---|---|---|---|
| 2,600,556 | 6/1952 | Malm | 5/93 R |
| 2,994,889 | 8/1961 | Oblander | 5/499 |
| 3,866,649 | 2/1975 | Bringmann | 446/227 |
| 4,523,745 | 6/1985 | Killman et al. | 5/424 |

*Primary Examiner*—Alexander Grosz
*Attorney, Agent, or Firm*—Norman E. Lehrer

[57] ABSTRACT

A protective pad for a crib rail is comprised of an elongated normally rectangularly shaped body of resilient foam material covered by a thin flexible sheet-like plastic. The side edges of the pad are undulated and include a plurality of fasteners on the high portions thereof. The fasteners, when fastened, extend between adjacent slats of the crib to maintain the pad in a substantially inverted U-shape wherein the same extends over the top and sides of the rail. Located within the pad is an elongated normally air-filled tubular member having a reed at one end thereof. When a force is exerted on the pad, air is forced out of the tube and through the reed to create a squeaking noise.

8 Claims, 2 Drawing Sheets

PROTECTIVE PAD FOR CRIB RAIL

BACKGROUND OF THE INVENTION

The present invention is directed toward a protective pad for a crib rail and more particularly toward such a pad which not only covers the crib rail to protect an infant from injury but which also emits a noise, thereby entertaining the infant.

As is well known in the art, babies are often confined in cribs or playpens or the like for considerable periods of time even during times that they are awake. Even at a very young age, such babies are able to stand up by themselves by grasping the vertical slats which form the side walls of the crib or playpen and pulling themselves up. Eventually, they grasp the horizontal rail which is supported at the top of the slats. Occasionally, a baby may fall against the rail and injure himself since these rails are normally made of a relatively rigid material.

Insofar as Applicant is aware, only one proposal has been made in the past to provide a protective pad for crib or playpen rails to protect a baby from injury. Such proposal is described in U.S. Pat. No. 2,600,556. The device shown in this patent is an elongated substantially rectangular-shaped pad having a cover therefor which is intended to be bent in an inverted U-shape to cover the top and side edges of a crib or playpen rail. Fasteners are also provided for maintaining the pad in place.

While the protective pad shown in U.S. Pat. No. 2,600,556 probably would provide the protection suggested therein, it would appear to have several drawbacks. First, the fasteners are adapted to secure the pad in only one position. Thus, the pad cannot easily accommodate rails of different sizes. Secondly, the pad cannot easily be utilized on a crib rail since no provisions are made for the vertical rail guides at the ends of the rails. Even further, the pad shown in this patent merely covers the rail and there is no other interaction between the baby and the protective pad. As a result, this pad does not encourage the baby to stand of lift himself up.

SUMMARY OF THE INVENTION

The present invention is designed to overcome the deficiencies of the prior art described above. The protective pad of the present invention is comprises of an elongated normally rectangularly shaped body of resilient foam material covered by a thin flexible sheet-like plastic. The side edges of the pad are undulated and include a plurality of fasteners on the high portions thereof. The fasteners, when fastened, extend between adjacent slats of the crib to maintain the pad in a substantially inverted U-shape wherein the same extends over the top and sides of the rail. Located within the pad is an elongated normally air-filled tubular member having a reed at one end thereof. When a force is exerted on the pad, air is forced out of the tube and through the reed to create a squeaking noise.

BRIEF DESCRIPTION OF THE DRAWINGS

For the purpose of illustrating the invention, there is shown in the accompanying drawings one form which is presently preferred; it being understood that the invention is not intended to be limited to the precise arrangements and instrumentalities shown.

DETAILED DESCRIPTION OF THE PREFERRED EMBODIMENT

Figure 1:
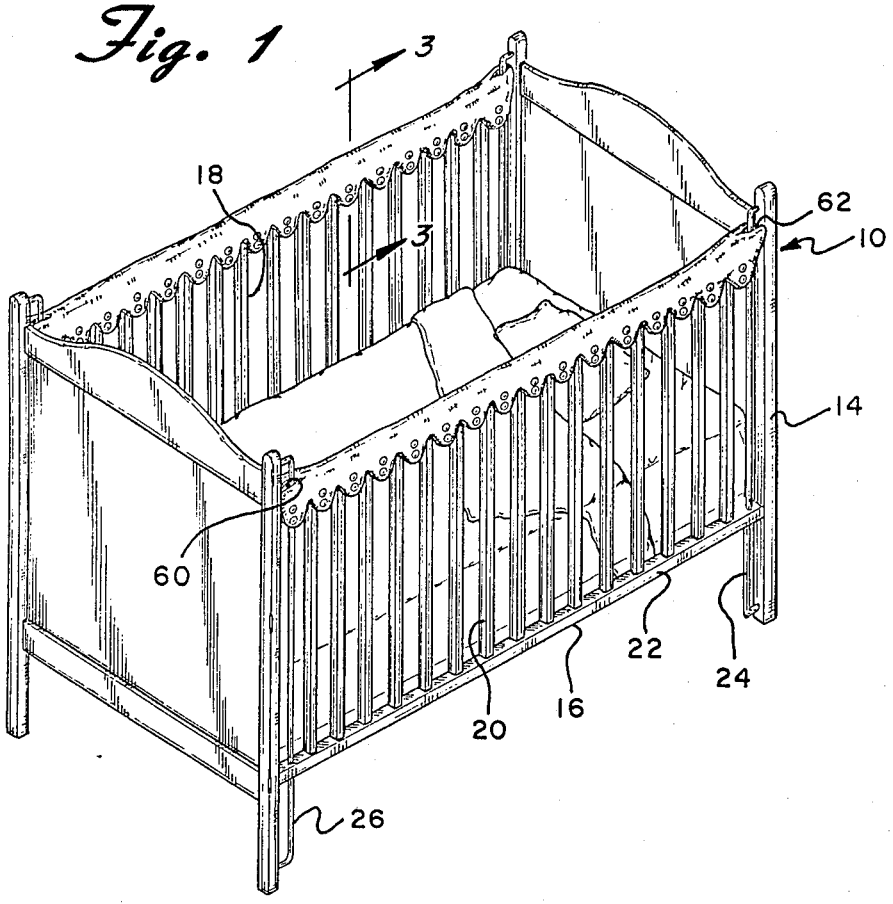
FIG. 1 is a perspective view of two protective pads constructed in accordance with the principles of the present invention and shown being attached to the rails of a crib.
Figure 2:
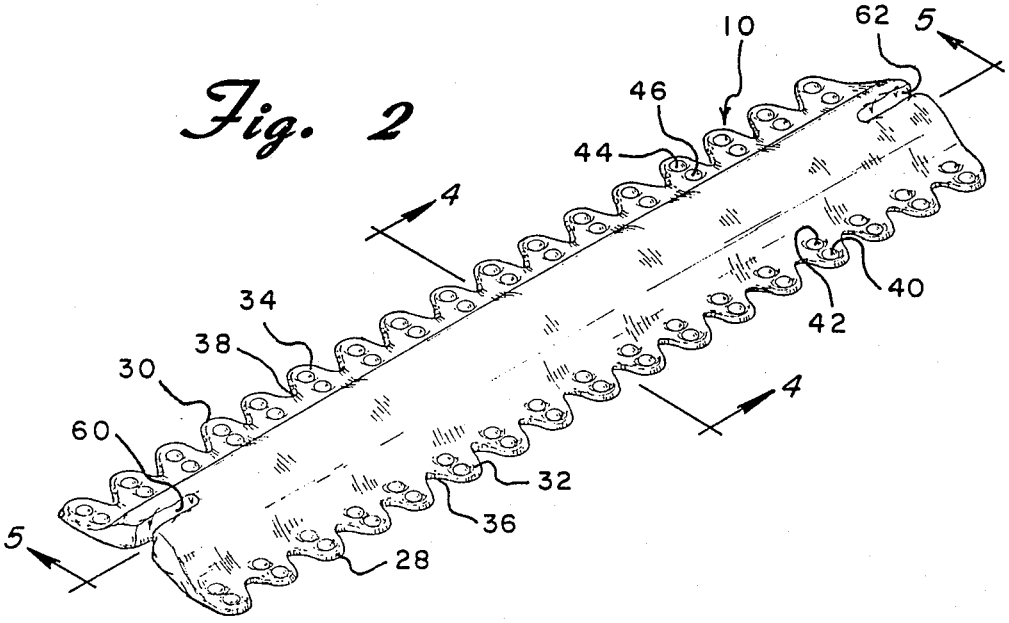
FIG. 2 is a perspective view of a protective pad showing the same in its fully open position.

Referring now to the drawings in detail wherein like reference numerals have been used throughout the various figures to designate like elements, there is shown in FIGS. 1 and 2 a protective pad for a crib rail constructed in accordance with the principles of the present invention and designated generally as 10. FIG. 1 shows the pad 10 secured to the upper rail 12 (FIG. 3) of crib 14 while FIG. 2 shows the pad 10 in its normal state.

Figure 3:
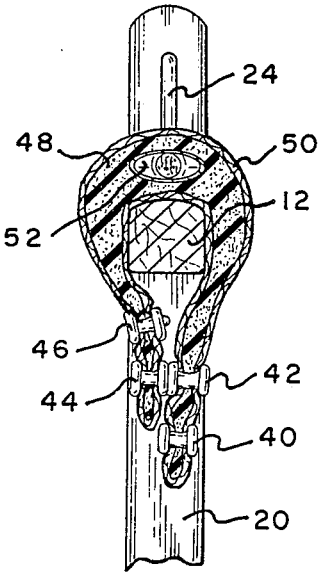
FIG. 3 is a cross-sectional view taken through the line 3—3 of FIG. 1.

The crib 14 is of conventional construction and includes side walls 16 and 18. The side walls are comprised of a plurality of vertical spaced apart slats 20 which are connected at their bottom by a horizontally extending bottom rail 22 and are connected at their tops by the horizontally extending top rail 12 (FIG. 3). With most cribs, the side walls 16 and/or 18 are vertically movable and are guided in their vertical movement by vertical rail guides 24 and 26. The crib 14 is of conventional construction and, accordingly, has only briefly been described. More specific details of the crib are not necessary for an understanding of the present invention and are presumed to be known by those skilled in the art. It should also be noted that while the present invention is being described specifically in association with the top rail of a crib, the same is also useful with the top rail of a playpen or similar structure such as shown in U.S. Pat. No. 2,600,556.

As shown most clearly in FIG. 2, the pad 10 is normally elongated and substantially rectangularly shaped. However, the side edges 28 and 30 are undulated, that is, they have a plurality of high spots formed therein such as shown at 32 and 34 and a plurality of low spots or indentations such as shown at 38. Each high portion 32 on the edge 28 of the pad 10 includes a plurality of fasteners 40 and 42. Similarly, each high portion on side edge 30 includes a plurality of complementary fasteners 44 and 46. The fasteners 40 or 42 are adapted to cooperate with the fasteners 44 or 46 to maintain the pad 10 in place as will become clearer hereinafter.

Figure 4:
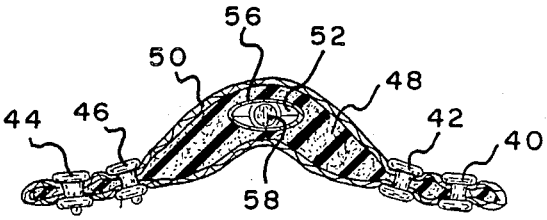
FIG. 4 is a cross-sectional view taken through the line 4—4 of FIG. 2.

The inner portion of the body of the pad 10, as shown most clearly in FIG. 4, is comprised of resilient material 48 which may be comprised of polyurethane foam or similar resilient material. This pad 48 is totally covered with a thin flexible sheet-like material 50. The material 50 may be comprised of a fabric cloth or a flexible plastic such as vinyl or the like. In any case, the cover material 50 should be capable of being easily wiped clean.

Located within the body of resilient material 48 and substantially centrally of the pad 10 are a pair of elongated pneumatic noisemakers 52 and 54. Each pneumatic noisemaker such as 52 is comprised of an elongated plastic tube 56 which is normally filled with air. The tube 56 is substantially flexible but is sufficiently rigid so as to substantially maintain its tubular shape. That is, if the tube 56 is deformed, it will resume its tubular shape after the deformation force is removed. Located at the end of the tube 56 is a reed or similar noisemaking element 58. The details of this reed 58 are not shown since the same is conventional in various types of children's squeeze toys and the like.

Figure 5:
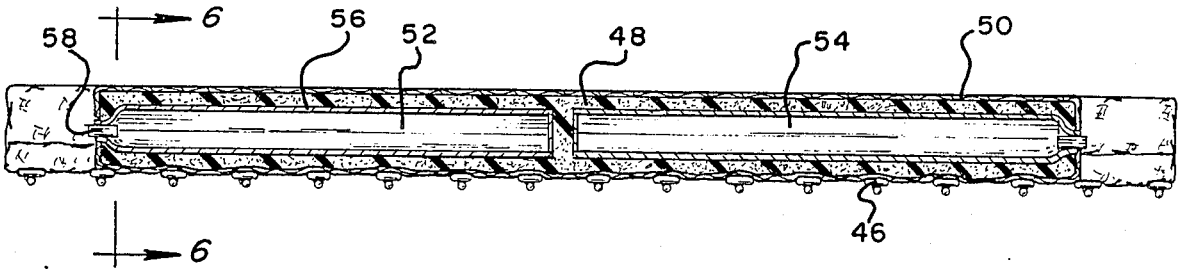
FIG. 5 is a cross-sectional view taken through the line 5—5 of FIG. 2.
Figure 6:
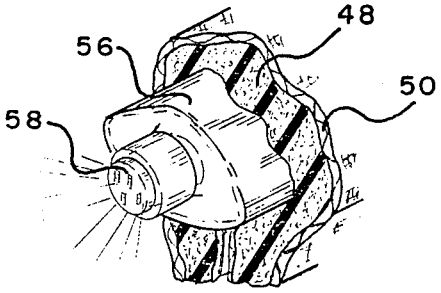
FIG. 6 is a view shown partially in cross section taken through the line 6—6 of FIG. 5.

Referring again to FIG. 2, it can be seen that each end of the pad 10 includes a slot 60 or 62 therein. The purpose of the slots 60 and 62 is to accommodate the vertical rail guides 24 and 26 when the pad 10 is in place on the crib rail as shown in FIG. 1. As shown in FIG. 5, the slots 60 and 62 also provide an opening into which the reed 58 can extend. As should be readily apparent to those skilled in the art, in order for the pneumatic noisemaker 52 to properly function, the reed 58 must be accessible to the outside of the pad 10 so that air can be expelled therefrom and withdrawn back therethrough.

The pad 10 described above is used in the following manner. First, the same is laid across the top of the rail 12. Thereafter, the side edges 28 and 30 of the pad 10 are bent downwardly so that the pad assumes a substantially inverted U-shape. At least one fastener such as fastener 40 or 42 from the side edge 28 is then fastened to one of the fasteners such as 44 or 46 from the side edge 30 in one of the spaces between adjacent slats 20. As shown in FIG. 3, fasteners 42 is secured to fastener 44. If a tighter fit were desired or if a smaller rail 12 were involved, fastener 42 could be secured to fastener 46. When the fasteners on one edge of the pad 10 are secured to the fasteners on the other edge in the manner described above, the pad is maintained in the substantially inverted U-shaped and covers the top and sides of the rail 12.

The pad 10 thus protects the rail 12 and a baby who may fall against the rail. Furthermore, should the baby strike the pad 10 or press against the same, air will be forced from the pneumatic noisemaker 52 or 54 thereby creating a noise through the reed 58. A baby will eventually learn that striking the rail pad will create this noise. This will encourage the baby to pull himself up and stand so as to interact with the pad.

The present invention may be embodied in other specific forms without departing from the spirit or essential attributes thereof and accordingly reference should be made to the appended claims rather than to the foregoing specification as indicating the scope of the invention.

I claim:

1. A protective pad for a crib rail having a plurality of spaced slats connected thereto comprising:

an inverted U-shaped body of soft resilient material extending over the top and sides of the rail;

a thin flexible sheet-like material covering said resilient material;

a plurality of fastener means carried on opposed edges of said pad, said fastener means, when fastened, extending between adjacent slats to detachably maintain said body in said U-shape, and a pneumatic noisemaker including an elongated air-filled tube having a reed adjacent one end thereof, said noisemaker being located within said body so as to overlie said rail when said pad is in place whereby said noisemaker emits a noise whenever a force is applied to said pad.

2. The invention as claimed in claim 1 wherein said flexible sheet-like material is comprised of plastic.

3. The invention as claimed in claim 1 wherein said pad is normally elongated and substantially rectangular in shape when not being maintained in said U-shape.

4. The invention as claimed in claim 3 wherein the side edges of said pad are undulated and include alternating high and low portions.

5. The invention as claimed in claim 4 wherein said fastener means are located on said high portions.

6. The invention as claimed in claim 1 wherein said pad includes a slot in each end thereof to accommodate the vertical guide rails of said crib.

7. The invention as claimed in claim 1 further including a second elongated air-filled tube including a reed adjacent one end thereof.

8. The invention as claimed in claim 1 wherein said fastener means are adjustable whereby said pad can accommodate a plurality of different size rails.

* * * * *